US006299038B1

(12) United States Patent
Schmeisser et al.

(10) Patent No.: US 6,299,038 B1
(45) Date of Patent: Oct. 9, 2001

(54) TELESCOPING TWIST CLOSURE

(75) Inventors: William C. Schmeisser, Barrington; Thomas C. Stoneberg, Buffalo Grove; Gary Berge, Crystal Lake, all of IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/656,431

(22) Filed: Sep. 6, 2000

(51) Int. Cl.[7] ..... B67D 3/00
(52) U.S. Cl. ..... 222/521
(58) Field of Search ..... 222/48, 519, 520, 222/521

(56) References Cited

U.S. PATENT DOCUMENTS

| | | | | |
|---|---|---|---|---|
| 3,216,630 | * | 11/1965 | Stull | 222/521 |
| 3,231,155 | | 1/1966 | McConnell . | |
| 4,065,037 | * | 12/1977 | Haller | 222/521 |
| 4,424,918 | * | 1/1984 | Stull | 222/521 |
| 4,438,870 | * | 3/1984 | Stull | 222/48 |
| 4,754,899 | * | 7/1988 | Stull | 222/521 |
| 4,805,807 | * | 2/1989 | Perne et al. | 222/521 |
| 4,967,941 | | 11/1990 | Beck . | |
| 5,111,977 | | 5/1992 | Maguire et al. . | |
| 5,135,139 | | 8/1992 | Krawagna . | |
| 5,421,487 | | 6/1995 | Moretti . | |
| 5,947,331 | | 9/1999 | Goncalves . | |

* cited by examiner

*Primary Examiner*—Philippe Derakshani
*Assistant Examiner*—Thach H. Bui
(74) *Attorney, Agent, or Firm*—Silverman, Cass & Singer, Ltd.

(57) ABSTRACT

A dispensing closure of three separately formed interlocking components including a container mountable base with a central post mounting a spout for vertical movement thereon between a closed position with a post mounted plug sealing within a spout aperture, and a second open position with the plug remote from the aperture, movement of the spout relative to the post and plug being achieved by a sleeve rotatably mounted on the base and engaged with the spout for rotation of the spout with the sleeve and, through cooperating engagement of the spout with the post, for longitudinal adjustment of the spout relative to the post.

19 Claims, 5 Drawing Sheets

TELESCOPING TWIST CLOSURE

BACKGROUND OF THE INVENTION

1. Field of the Invention

This invention relates generally to dispensing closures for containers, and more particularly, to such closures utilizing a self-sealing telescoping spout with a twist action control member for operation thereof.

2. Description of the Prior Art

Twist top closures are known in which a cap with a central aperture cooperates with an upstanding post formed on a base to open or close the closure. The base is affixed to the mouth of a product container, such as a water bottle, and when the cap is moved, such as by twisting or pulling relative to the base, the post on the base is withdrawn from engagement with the aperture in the cap to permit product, such as water, to be dispensed from the container. After dispensing of the product is completed, the cap is returned to its closed position by reverse-twisting or pushing on the cap to reengage the post in the aperture, thereby closing the closure and preventing product from being dispensed from the container.

Examples of such known closures are shown in U.S. Pat. No. 5,947,331, issued Sept. 7, 1999, entitled "Dispensing Closure with Retracting End for Containers"; U.S. Pat. No. 5,421,487, issued Jun. 6, 1995, entitled "Dispenser Cap for a Fluid Substance Container, with a Movable Dispensing Nozzle"; and U.S. Pat. No. 4,967,941 (owned by wholly-owned subsidiary of the assignee of the present application), issued Nov. 6, 1990, entitled "Twist Lock Adjustable Metering Closure Cap".

Attention is also directed to copending application Ser. No. 09/415,797, filed Oct. 11, 1999, entitled "Universal Base Pull/Push-Twist Closure", owned by the same assignee as the assignee of the present application, and disclosing a base similar to the base of the present invention. The disclosure of the copending application is hereby incorporated herein by reference.

The rather active nature of this field of invention is encouraged by several factors with the goal of providing, for the user, a closure which, during periods of non-use, can be effectively sealed, and which, during use, can be easily manipulated or opened and closed. Similarly, the closure should be readily accommodated to the mouth, as when water or juice is to be directly discharged into the mouth with the lips normally encircling the closure or a portion thereof.

Other considerations encouraging activity in this field of invention comprise those associated with the costs of the closure itself, including most particularly economies which can be realized in the manufacturing procedures and the equipment required for the molding of the closure components. Basically, if the rather elaborate or intricate nature of many of the components of closures heretofore devised can be simplified, while at the same time providing a closure having significant operational advantages, substantial manufacturing advantages will also be realized.

SUMMARY OF THE INVENTION

The present invention is concerned with a closure which provides for a unique combination of components which are formed as to allow for substantial manufacturing economies, while at the same time providing for a unique operational relationship between the components to provide a closure which is simple to manipulate, allows for a positive discharge of a product, and which can be effectively sealed.

More specifically, the closure of the invention includes a base adapted to be mounted to a container, as by screw thread engagement with an externally threaded container neck. The base includes a central vertically extending post with a plug mounted at the upper end thereof.

A spout is telescopically received over the post and includes a central aperture which aligns with the plug for selective sealing engagement of the plug within the aperture to preclude fluid discharge. The spout is to move vertically to selectively lower the spout aperture into sealing engagement with the plug and raise the spout to upwardly retract the aperture from the plug. A screw thread engagement is provided between the spout and the post whereby rotation of the spout about the post will effect the desired raising and lowering of the spout.

In order to provide for the desired vertical adjustment of the spout, a spout encircling sleeve is rotatably engaged with the base and retained against vertical movement relative to the base. The sleeve and spout are retained for simultaneous rotation of the spout with the sleeve as the sleeve is rotated relative to the base, this rotation of the spout producing a corresponding vertical adjustment of the spout relative to the sleeve and base. Basically, the spout includes a top which is of a non-circular configuration, preferably elliptical, which is received within the corresponding elliptically shaped upper portion of the sleeve to allow for axial movement of the spout within the sleeve while precluding relative rotation therebetween. The exterior of the sleeve is configured, upward from a cylindrical lower portion thereof which engages the base, with opposed slightly flattened finger grip areas corresponding to the opposed long sides of the elliptical top of the spout which allows for an easy manual manipulation of the sleeve. In fact, such opposed preferably smooth slightly arcuate grip areas can comfortably receive the lips of a consumer of the product with the container rotated relative to the lip confined sleeve to effect an alternate means for opening and closing the closure. In this manner, one involved in physical activity, such as bicycling, can readily access the container contents without requiring separate manual manipulation of the closure.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages of the invention.

DESCRIPTION OF THE PREFERRED EMBODIMENT

Figure 1:
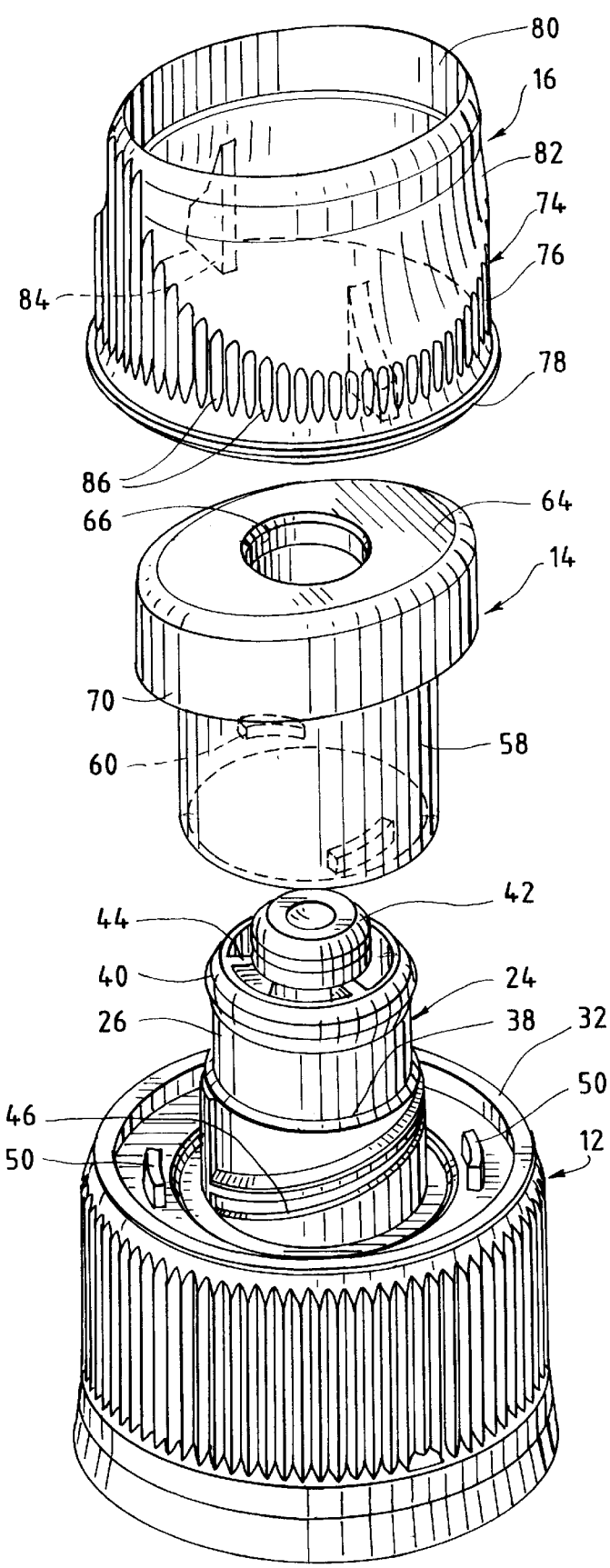
FIG. 1 is an exploded perspective view showing the three basic components of the closure, the base, the spout and the control sleeve.

Referring now more specifically to the drawings, the closure 10, preferably formed of an appropriate foodcompatible plastic, comprises three molded components, the base 12, the spout 14 and the control member or sleeve 16.

The base 12 is adapted for attachment to a container top (not shown) in known manner, such as by screw threads 18 formed on the inner surface of the cylindrical side wall 20 of the base body which mate with like threads on a container neck. The base body also includes a top panel 22 extending inward from the body side wall 20. A vertically elongate post 24, normally integrally molded with the top panel 22, extends vertically therefrom coaxial with and inwardly spaced from the surrounding body wall 20. The post 24 has a cylindrical side wall 26 defining a product flow passage 28 vertically therethrough and opening through the body top panel 22. The post 24, having a radial dimension less than that of the body side wall 20, forms a concentric channel 30 about the post and between the post wall 26 and a sleeve retention flange 32 defined from the upper portion of the body side wall 20 peripherally thereabout and extending upward from the arcing inward over the base top panel 22. The purpose of this retention flange will be explained subsequently.

The external surface of the post wall 26 includes a lower portion 34 and an upper portion 36 with an annular abutment surface or shoulder 38 formed therebetween.

An annular sealing rib 40 is formed proximate to the upper terminal end of the upper portion 36 of the post 24 and extends circumferentially about the external surface of the post. A closure or sealing plug 42 is centrally positioned within the upper terminal end portion of the post 24 and projects vertically therefrom in radially inwardly spaced relation to the post wall. The plug is supported by a support spider formed of spaced radially extending spokes 44 which minimally restrict the flow if discharging product annularly about the plug 40 in its open position as shall be described subsequently.

The lower portion 34 of the post wall is formed with a pair of diametrically opposed helical groove channels 46.

The base top panel 22, in immediate surrounding relation to the post 24, has an upwardly directed annular seating groove 48 formed therein. Outward of this groove, and inward of the peripheral retaining flange 32, the top panel 22 is provided with a pair of diametrically opposed stop tabs 50. As desired, the under surface of the top panel 22 can be provided with an annular depending sealing rib 52 adapted to engage with the top of a container neck about the opening therein. Also, and as suggested in FIG. 3, an appropriate tamper-evident skirt 54 can be provided peripherally about the lower edge of the cylindrical body wall 20. In order to facilitate mounting of the closure, it is contemplated that the exterior surface of the body wall 20 be provided with vertical gripping ribs 56 peripherally thereabout.

Referring now to spout 14, the spout includes a vertically elongate cylindrical side wall 58 telescopically receivable over the base post 24. The spout 14 has inwardly projecting helical thread segments or lugs 60, note in particular FIGS. 1 and 5, engaged within the helical post grooves 46 which are provided with appropriate respective starting openings and terminal openings to allow for the initial engagement of the lug 60 therein upon a mounting of the spout.

The spout 14 includes a top 62 having a top panel 64 integral with and transversely across the upper end of the spout side wall 58. The top panel 64 extends at least partially beyond the spout side wall 58 radially outward therefrom and is of a non-circular configuration, preferably elliptical as illustrated. As such, and as suggested in FIG. 5, the minor dimension of the elliptical top 62 will be only slightly greater than the diameter of the spout side wall 58, while the top, at the maximum diameter thereof, will extend a substantial radial distance outward from the spout side wall 58.

Figure 3:
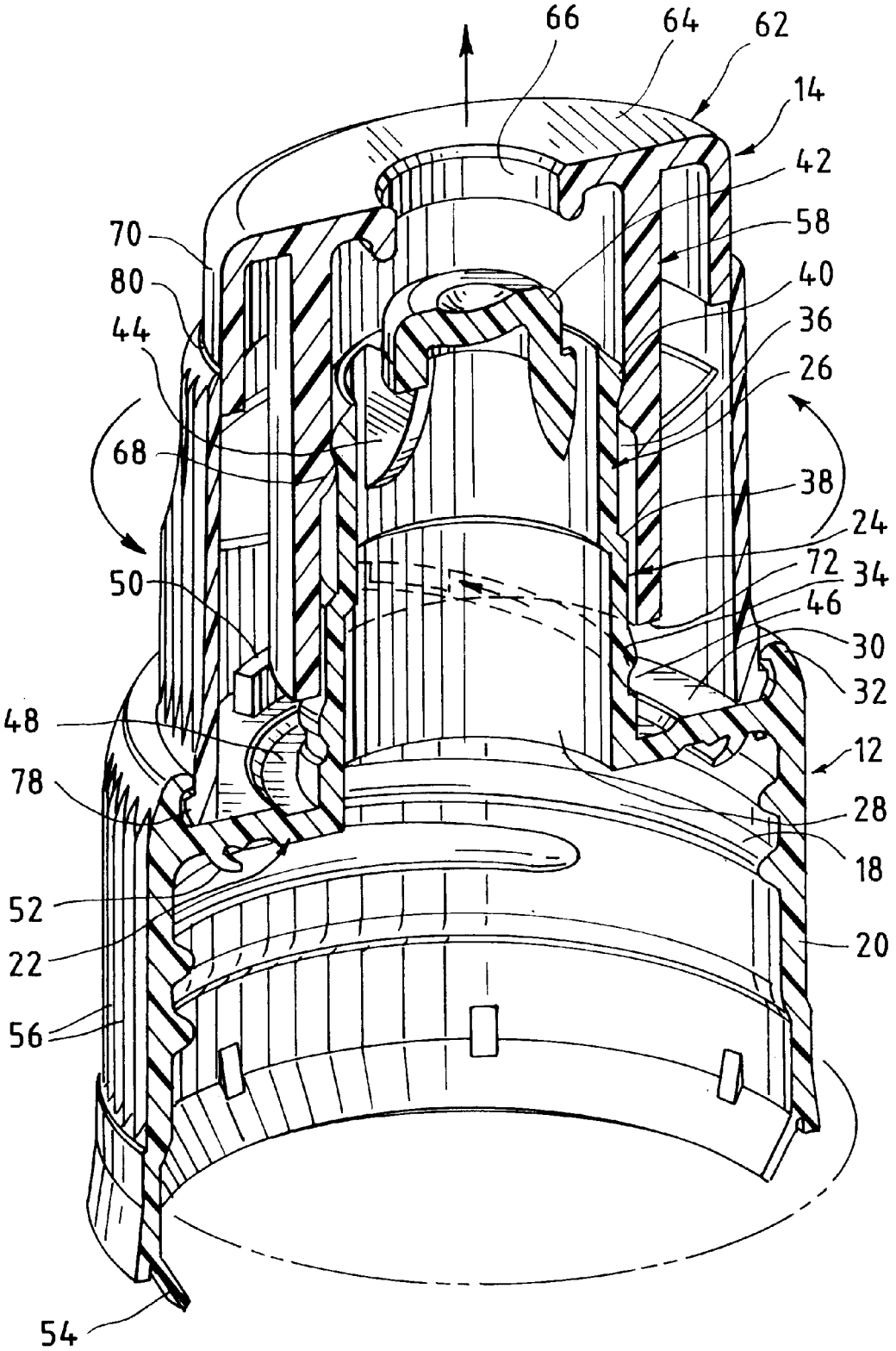
FIG. 3 is a cross-sectional perspective view of the closure with the spout open.
Figure 4:
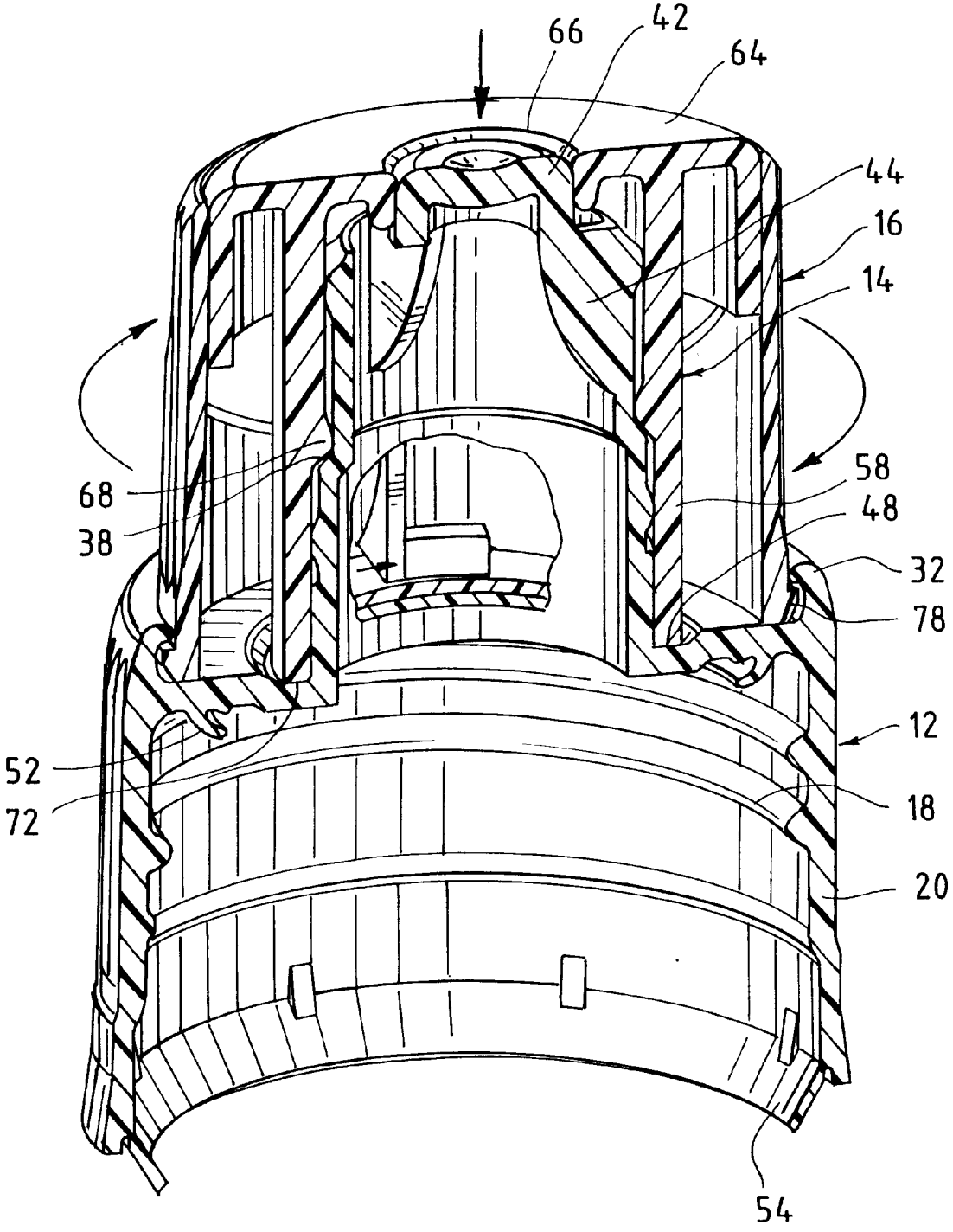
FIG. 4 is a cross-sectional perspective view of the spout closed.

The top 62, and more particularly the top panel 64, includes a central aperture 66 therethrough aligned with plug 42 and of a complementary configuration whereby reception of the plug 42 within the aperture 66, as illustrated in FIG. 4, seals the aperture and prevents discharge of the product therethrough. The extent of vertical upward movement of the spout 14, as illustrated in FIG. 3, is sufficient so as to effect a complete and substantial relative withdrawal of the plug 42 from the spout 66 for product discharge. In this maximum open position, it will also be noted that an inwardly directed annular sealing rib 68 on the inner surface of the spout side wall 58 seats upwardly against corresponding sealing rib 40 on the base post. It is also to be appreciated that the sealing rib 40 is such as to maintain sealing engagement with the respective spout wall throughout vertical adjustment of the spout as shall be explained subsequently.

Figure 5:
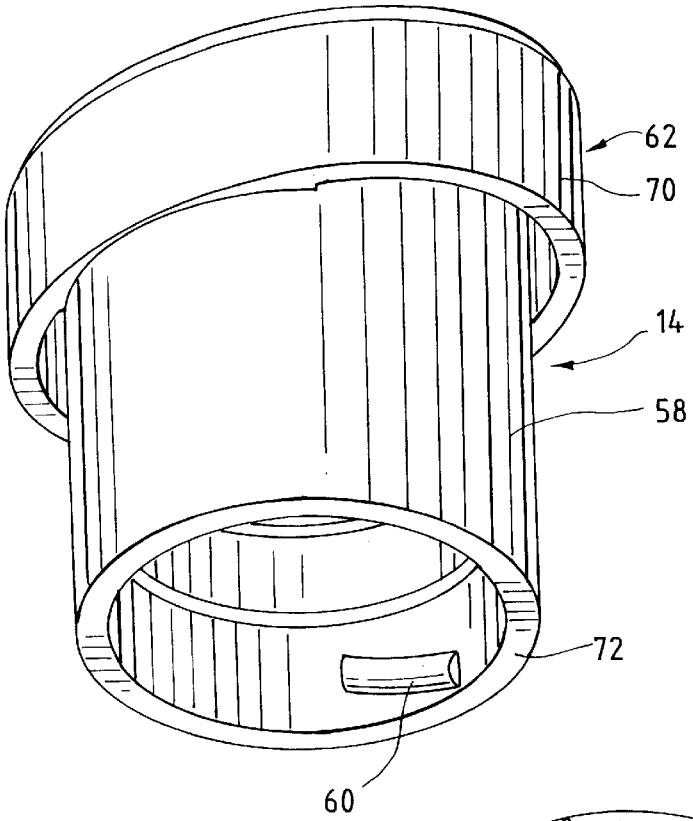
FIG. 5 is a bottom perspective view of the spout.
Figure 6:
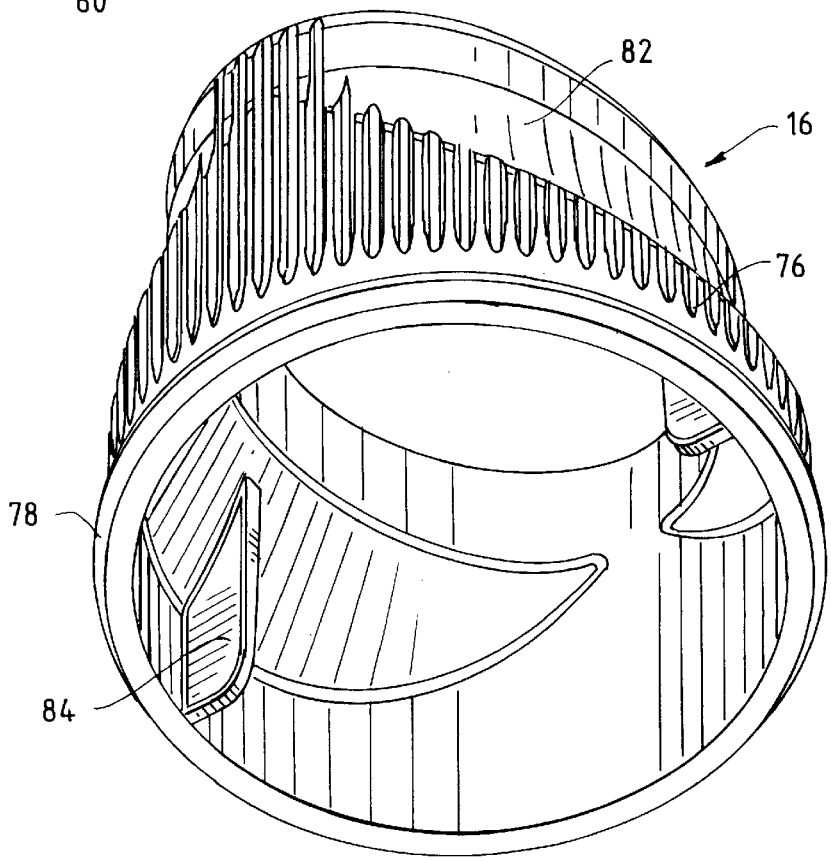
FIG. 6 is a bottom perspective view of the sleeve.

The spout top 62 also includes a continuous side skirt 70 depending from the elliptical periphery of the top panel 64 completely thereabout and in outwardly spaced relation to the spout side wall 58 at least to the opposite sides of the minimum diameter dimension of the top, again note in particular FIG. 5.

Referring to FIG. 4, it will noted that the lower terminal edge 72 of the spout side wall 58, in the lowermost or closed position of the spout, seats within the upwardly directed annular groove 48 in the base top panel 22, and the internal sealing rib 68 on the spout side wall 58 seats on the shoulder 38 of the base post, thereby to potentially provide an effective secondary seal location, if needed.

The manipulation of the spout 14, that is the axial movement thereof between the open position of FIG. 3 and the closed position of FIG. 4, is effected by the control member or sleeve 16. The sleeve 16 includes a peripheral wall 74 with a lower cylindrical wall portion 76 having an integral outwardly directed retention lip 78 about the terminal lower edge thereof. The lip 78 is rotatably received and retained within the upper inwardly overhanging retention flange 32 on the base wall 20 above the base panel 22 with the relationship between the retention lip 78 and retention flange 32 being such whereby the lower edge of the sleeve 16 is slidably supported on the base top panel 22 for rotation about the base. Vertical disengagement of the sleeve 16 from the base 12, once the sleeve retention lip 78 is snapped into position, is prevented by the base retention flange 32 while the cooperative relation therebetween allows for the required relative rotational movement of the sleeve relative to the base.

As will be appreciated from FIGS. 3 and 4, the sleeve wall 74 is outwardly spaced from the spout side wall 26 with the skirt 70 of the spout top 62 closely and slidably received within the open upper end 80 of the sleeve 16. In order to slidably accommodate the skirt 70 of the spout top 62, the upper portion 82 of the sleeve wall 74 gradually tapers, from the cylindrical lower wall portion 76, to an upper elliptical configuration at the open upper end 80 thereof which closely conforms to the elliptical configuration of the top 62 of the spout 14. The relationship between the configuration of the top 62, preferably elliptical, to the correspondingly configured upper portion and open upper end of the sleeve 16 is such whereby the spout, while vertically or axially movable relative to the sleeve, is confined against rotation relative thereto. Thus, rotation of the control member or sleeve 16 will effect a simultaneous rotation of the spout 14 with the helical engagement means of the spout to the base post effecting a corresponding axial adjustment of the spout relative to both the base and the sleeve.

In order to prevent overtravel of the sleeve beyond the maximum opposed open and closed positions of the spout, the sleeve 16 is provided, within the cylindrical lower portion 76 of the wall 74 thereof, with opposed radially inwardly projecting sleeve retention flanges or ribs 84 which so relate to the stop tabs or lugs 50 on the base top penal 22 as to, upon abutment therewith, limit further rotation of the sleeve and axial adjustment of the spout. The aforesaid positioning is such as to, of course, correspond with the extreme open and closed positions of the spout.

Figure 2:
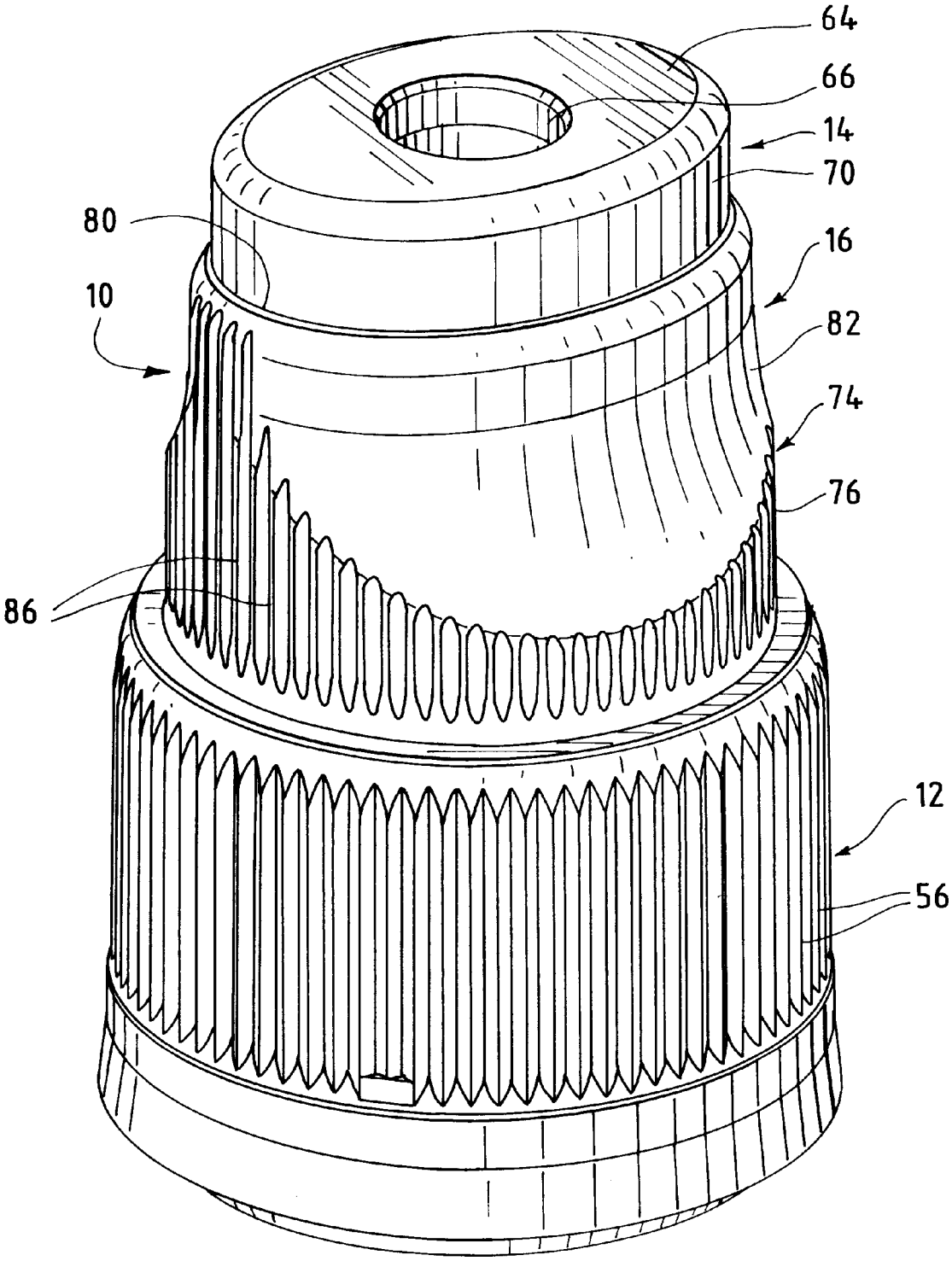
FIG. 2 is a perspective view of the components assembled.

Noting FIGS. 1 and 2 in particular, gripping ribs 86 are provided peripherally about the lower cylindrical portion 76 of the sleeve wall with these gripping ribs, at opposed areas of maximum diameter of the elliptical upper end of the sleeve, extending vertically for the full height of the sleeve wall. It is preferred that the opposed long sides of the upper wall portion 82, both at the elliptical extreme upper end thereof and in the transition area above the cylindrical lower portion 76, be without ribs, whereby opposed smooth surfaces are provided for the accommodation of the lips of a user. Such opposed smooth wide surfaces also provide convenient gripping areas for a finger manipulation of the sleeve when the closure is to be opened or closed.

In use, the closure is initially assembled by snap locking the three separately molded components together with the spout 14 received for rotational and axial movement on the base post 24 and the sleeve received on the base for rotational movement relative thereto. The spout is retained on the post against movement beyond its maximum open position by engagement of the post and spout sealing flanges 40 and 68, while the sleeve is retained by the engaged sleeve retaining lip 78 and base retaining flange 32.

As previously described, the spout comprises the only axially adjustable member, movable from a substantially completely concealed position to a slightly elevated open position through manipulation of the separately formed control member or sleeve. The separate molding of the components allows for more efficient manufacturing procedures and the possibility of achieving economic advantages resulting therefrom. The formation of the closure utilizing individually molded components is made possible by the unique interrelationship of the components into an operating unit as described above.

Other configurations and variations in the structure, arrangement and size of the various parts may occur to those skilled in the art without department from the spirit or circumventing the scope of the invention as set forth in the appended claims.

What is claimed is:

1. A container closure comprising, a base adapted to be secured to the mouth of the container for a controlled dispensing of a product from the container, the base including a body, the body having a top panel and a side wall depending peripherally from said top panel, a central post projecting axially upward from said top panel centrally thereof in radially inwardly spaced relation to said body side wall, said post having a cylindrical side wall defining a product flow passage vertically therethrough and opening through said top panel, said post passage having an open upper end vertically remote from said top panel, a sealing plug centrally positioned relative to said passage at said upper end and radially inward of the cylindrical wall of the post to allow for product movement past said plug, means for mounting said plug to said post wall with minimal restriction of the passage outward of the plug, a spout including a cylindrical side wall telescopically received over said post, said spout having a non-circular top overlying said post and said passage therethrough, said spout top extending radially outward from said spout wall at least partially thereabout, said top having a central aperture therethrough aligned with said plug for discharge of a product from said passage through said aperture, said spout being telescopically adjustable on said post between a lower closed position with said plug engaged in and sealing said aperture, and an upper open position with said plug spaced below said aperture to allow product discharge through said aperture, and means for telescopically adjusting said spout relative to said plug, said means for telescopically adjusting said spout including a manual control member outward of said spout, the control member having a lower portion proximate said base body top panel, means for retaining said lower portion on said top panel for rotation relative thereto about said spout, the control member having an upper portion defining an opening configured to conform to said non-circular top and receiving said top therein whereby rotation of said control member will effect a corresponding rotation of said top and said spout, and cooperating means on said spout and said base post for telescopically moving said spout on said post in response to rotation of said spout relative to said post.

2. A container closure as claimed in claim 1 wherein said control member comprises a sleeve encircling the post, said lower portion of said control member being cylindrical, said upper portion of said control member dimensionally differing from said cylindrical lower portion thereof and defining finger grip areas distinct from said cylindrical lower portion.

3. A container closure as claimed in claim 2 wherein the spout top is elliptical, said upper portion of said sleeve and said opening therein, being of a conforming elliptical configuration.

4. A container closure as claimed in claim 3 wherein said cooperating means on said spout and said base post comprise at least one helical groove in one of said post side walls and said spout side wall, an at least one cooperating lug on the other of said post side wall and said spout side wall.

5. A container closure as claimed in claim 4 including means for limiting rotational movement of the sleeve about the post between open and closed positions of the spout.

6. A container closure as claimed in claim 5 wherein said means for limiting rotational movement of said sleeve about said post comprise stop tabs on said base top panel and stop ribs on said sleeve projecting radially inward of said lower wall portion of said control member in alignment with said stop tabs.

7. A container closure as claimed in claim 6 wherein the spout top includes a top surface with a depending skirt peripherally thereabout, said spout in said closed position having said top surface substantially coplanar with said plug.

8. A container closure as claimed in claim 7 wherein said spout, in the open position thereof, having the top surface thereof positioned axially upward from said plug and above said sleeve.

9. A container closure as claimed in claim 1 wherein said cooperating means on said spout and said base post comprise plural helical grooves on said post side wall, and cooperating lugs on said spout side wall engaged within said grooves for travel therealong.

10. A container closure as claimed in claim 2 including means for limiting rotational movement of the sleeve about the post between open and closed positions of the spout, said means for limiting rotational movement comprising stop tabs on said base top panel and stop ribs on said sleeve projecting radially inward of the lower portion of the control member and in engaging alignment with said stop tabs.

11. A container closure as claimed in claim 2 wherein said spout top includes a top surface with a depending skirt peripherally thereabout, said spout in said closed position having said top surface substantially coplanar with said plug, said top surface, in said open position of said spout, being positioned axially upward from said plug and above said sleeve.

12. A container closure as claimed in claim 11 including means for limiting rotational movement of the sleeve about the post between open and closed positions of the spout, said means for limiting rotational movement comprising stop tabs on said base top panel and stop ribs on said sleeve projecting radially inward of the lower portion of the control member and in engaging alignment with said stop tabs.

13. A container closure comprising, a base adapted to be secured to the mouth of a container for a controlled dispensing of a product from the container, said base including a body, the body having a top panel, a post projecting upward from said top panel, said post having a side wall defining a product flow passage vertically therethrough and opening through said top panel, said post passage having an open upper end remote from said top panel, a sealing plug positioned relative to said passage at said upper end and radially inward of the wall of the post to allow for product movement past the plug, means for mounting said plug to said post wall with minimal restriction of the passage outward of the plug, a spout including a side wall telescopically received over said post, said spout having a top overlying said post and said passage therethrough, said top having an aperture therethrough aligned with said plug for discharge of a product from said passage through said aperture, said spout being telescopically adjustable on said post between a lower closed position with said plug engaged in and sealing said aperture, and an upper open position with said plug spaced below said aperture to allow product discharge through said aperture, and means for telescopically adjusting said spout relative to said plug, said means for adjusting said spout comprising a control member outward of said spout, the control member having a lower portion proximate said base top panel, means for retaining said lower portion of said control member on said top panel for rotation relative thereto about the spout, the control member having an upper portion defining an opening conforming to the top and receiving the top therein, said opening and said top including cooperating means precluding rotation of the top in the sleeve opening while allowing axial movement therebetween, whereby rotation of said control member will effect a corresponding rotation of said top and spout.

14. A container closure as claimed in claim 13 including cooperating means on said spout and said base post for telescopically moving said spout on said post in response to rotation of said spout relative to said post.

15. A container closure as claimed in claim 14 wherein said control member comprises a sleeve encircling the post, said lower portion of said control member being cylindrical, said upper portion of said control member dimensionally differing from said cylindrical lower portion thereof and defining finger grip areas distinct from said cylindrical lower portion.

16. A container closure as claimed in claim 15 wherein the spout top is elliptical, said upper portion of said sleeve and said opening therein being of a conforming elliptical configuration.

17. A container closure as claimed in claim 16 wherein said cooperating means on said spout and said base post comprise at least one helical groove in one of said post side walls and said spout side wall, and at least one cooperating lug on the other of said post side wall and said spout side wall.

18. A container closure as claimed in claim 17 including means for limiting movement of the sleeve about the post between open and closed positions of the spout, said means for limiting rotational movement comprising stop tabs on said base top panel and stop ribs on said sleeve projecting radially inward of the lower portion of the sleeve and in engaging alignment with said stop tabs.

19. A container closure as claimed in claim 16 wherein said spout top includes a top surface with a depending skirt peripherally thereabout, said spout in said closed position having said top surface substantially coplanar with said plug, said top surface, in said open position of said spout, being positioned axially upward from said plug and above said sleeve.

* * * * *